US005662396A

United States Patent [19]

Reeder et al.

[11] Patent Number: 5,662,396

[45] Date of Patent: Sep. 2, 1997

[54] BEDSIDE CABINET FOR STORING APPLIANCES

[75] Inventors: Ryan Anthony Reeder, Brookville, Ind.; Ares Marasligiller, Villa Hills, Ky.

[73] Assignee: Hill-Rom, Inc., Batesville, Ind.

[21] Appl. No.: 503,017

[22] Filed: Jul. 17, 1995

[51] Int. Cl.[6] ..... A47B 81/00; A47B 46/00

[52] U.S. Cl. ..... 312/209; 312/249.12; 312/235.3; 312/249.9; 312/351.4; 312/237; 312/249.4; 312/309; 4/483; 135/66

[58] Field of Search ..... 312/209, 351.4, 312/249.4, 249.5, 249.8, 249.9, 249.11, 237, 235.2, 235.3, 293.2, 239, 249.12, 309, 310, 21, 30; 4/83, 476, 478, 479, 480, 483, 465; 135/65, 66, 67

[56] References Cited

U.S. PATENT DOCUMENTS

| | | | |
|---|---|---|---|
| 472,673 | 4/1892 | Lewing | 312/235.2 X |
| 472,826 | 4/1892 | Rudrof | 4/483 |
| 915,442 | 3/1909 | Johnson | 312/235.2 |
| 1,409,330 | 3/1922 | Aper | 312/235.3 X |
| 1,568,498 | 1/1926 | Caliver | 312/235.3 |
| 1,928,327 | 9/1933 | Butler | 312/310 |
| 2,614,018 | 10/1952 | Engel | 312/239 X |
| 3,087,767 | 4/1963 | Schell | 312/239 X |
| 3,984,162 | 10/1976 | Zozzaro | 312/235.3 X |
| 4,474,202 | 10/1984 | Blechner . | |
| 4,491,375 | 1/1985 | Ugalde | 312/249.12 X |
| 4,572,594 | 2/1986 | Schwartz | 312/209 |
| 4,993,782 | 2/1991 | Williams | 312/21 |
| 5,011,240 | 4/1991 | Kelley et al. | 312/249.12 |
| 5,068,927 | 12/1991 | Massaro | 4/483 X |
| 5,205,629 | 4/1993 | Simons | 312/249.9 |

FOREIGN PATENT DOCUMENTS

| | | |
|---|---|---|
| 1 554 483 | 4/1970 | Denmark . |
| 399 098 A1 | 11/1990 | European Pat. Off. . |
| 85705 | 11/1919 | Switzerland . |

OTHER PUBLICATIONS

Waterloo Catalog, "The Storage & Delivery Systems Solution", Sep. 1986, pp. 1–21.

Product brochure of Hill–Rom, Inc. entitled "The Elite$_{T.M.}$ Bedside Cabinet From Hill–Rom®" dated 1989.

*Primary Examiner*—Peter M. Cuomo
*Assistant Examiner*—James O. Hansen
*Attorney, Agent, or Firm*—Barnes & Thornburg

[57] ABSTRACT

A bedside cabinet having a generally U-shaped forward access area within which a portable commode may be stored. The cabinet includes an upper drawer cabinet section an a pivoting top panel under which is stored an adjustable shelf. The top panel is pivoted to a vertical position, the adjustable shelf is elevated and locked in a desired position and the top panel is then lowered to its normal horizontal position. The portable commode is designed to ft within the cabinet for storage; and in addition, a walker is designed to fit around and be stored on the cabinet.

25 Claims, 5 Drawing Sheets

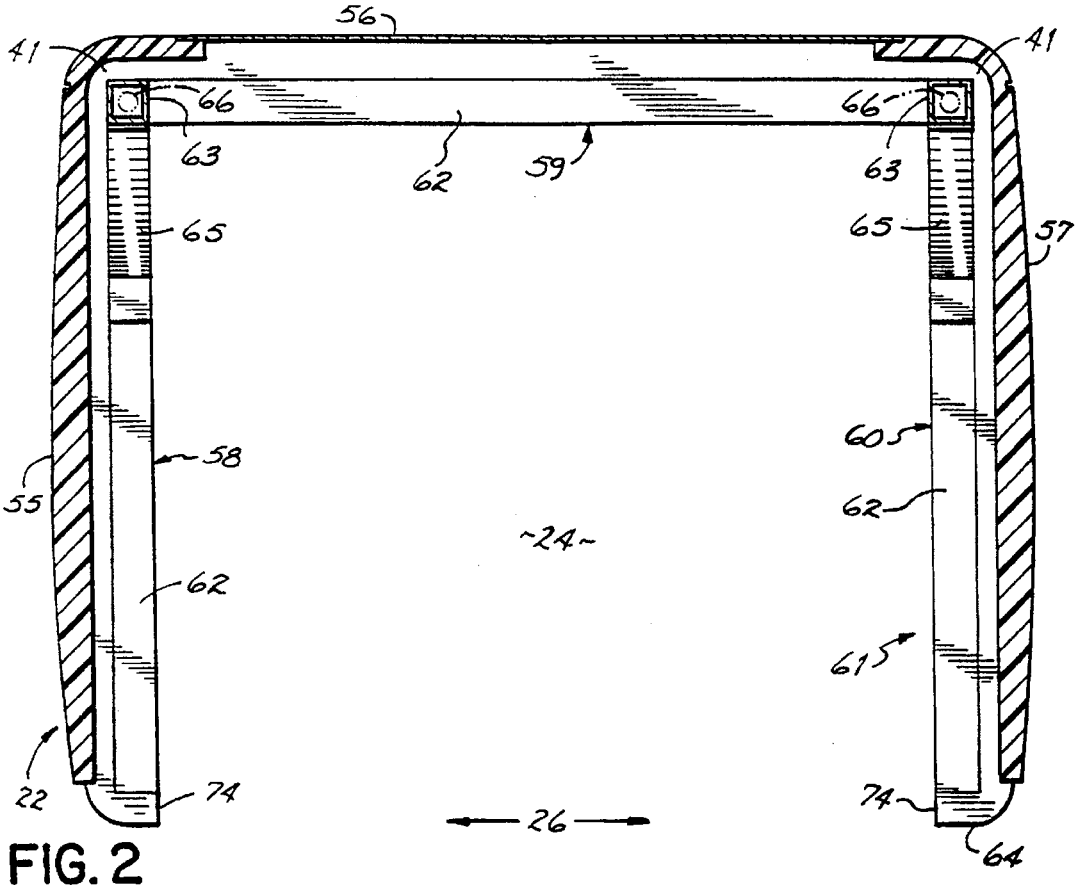
FIG. 2
FIG. 3
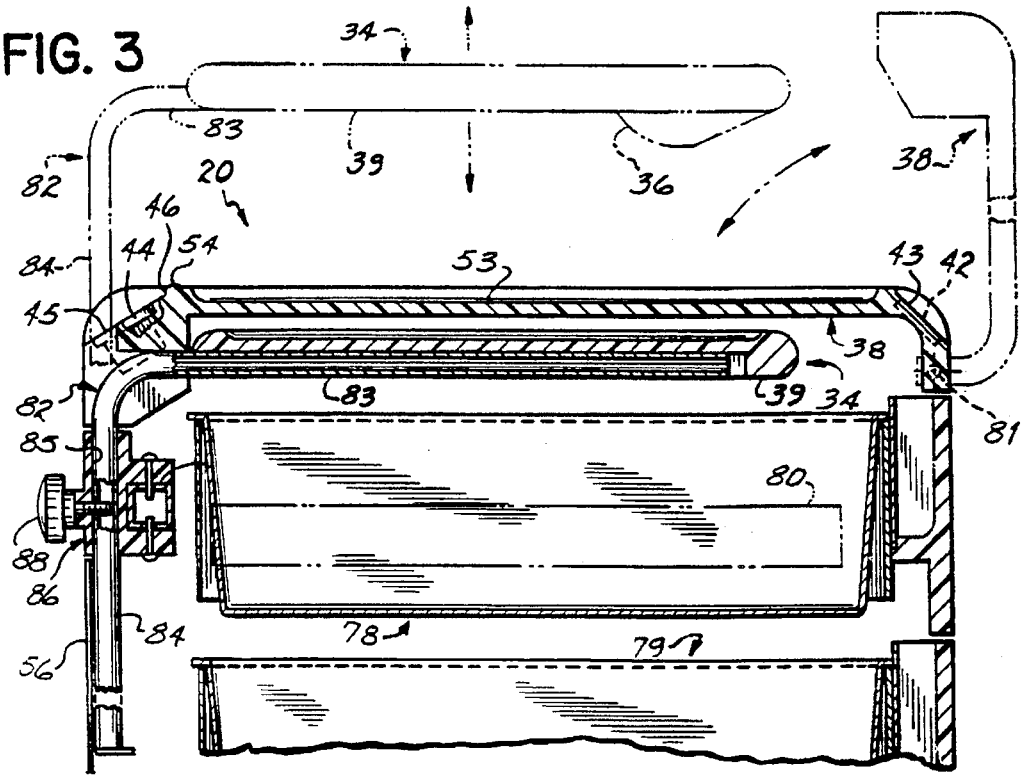

FIG. 7
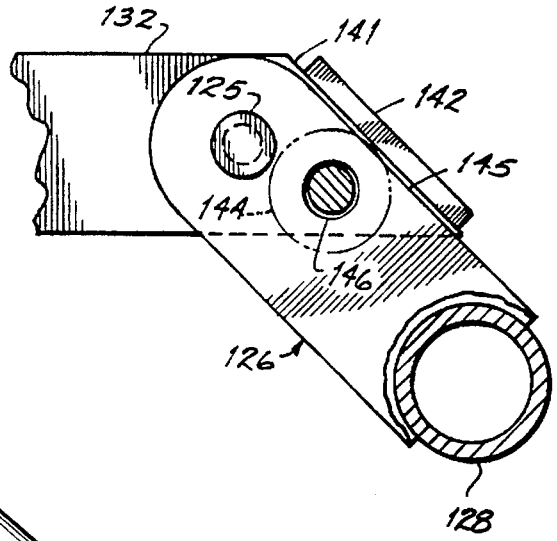
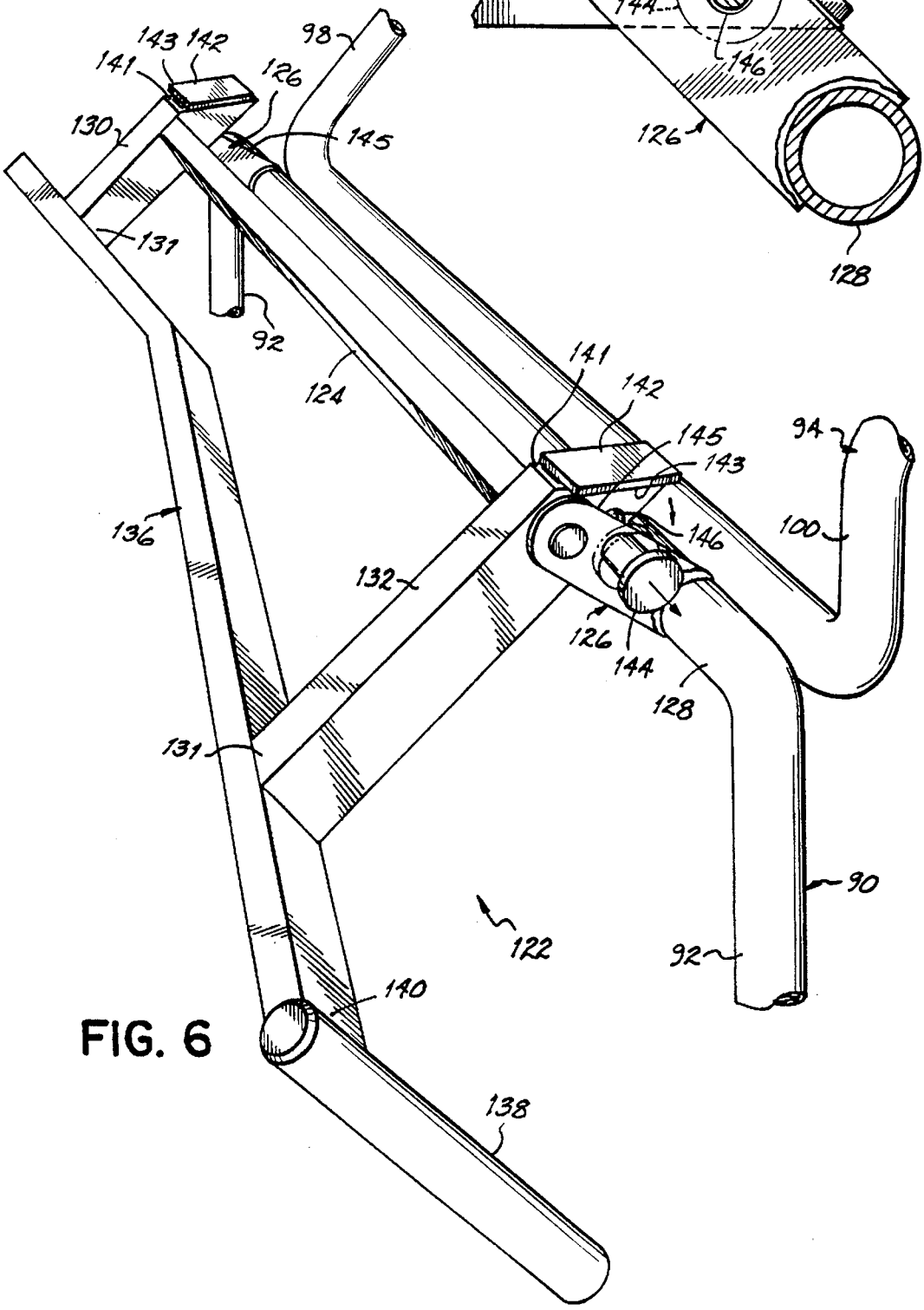
FIG. 6

BEDSIDE CABINET FOR STORING APPLIANCES

FIELD OF THE INVENTION

This invention relates generally to cabinets, and more particularly, to a bedside cabinet for storing appliances, for example, a portable commode and/or a walker.

BACKGROUND OF THE INVENTION

There are many people who either, all of the time, or, some of the time, have problems walking. Those people often spend more time in bed and require a walker to support them in their walking activity. Further, it is common that such a person desires to have a commode in the same room with their bed. However, beds, especially hospital-type beds, are large, and the rooms in which they are located are often small. In some environments, for example, in hospitals and nursing homes, rooms are shared with others; and consequently, floor space in rooms with beds is at a premium. Having a commode and walker located around the bed has the disadvantage of taking up space that could otherwise be used for a chair, chest of drawers or other furniture. Another disadvantage is that appliances such as a commode or walker are often moved from one location to another and always seem to be in the wrong place or in the way. Further, such appliances are not generally attractive or appealing to the eye, and their presence in full view often detracts from an otherwise visually pleasant environment.

SUMMARY OF THE INVENTION

An object of the present invention is to provide a bedside cabinet that improves the utilization of space in a room, especially a room with a bed, for example, a hospital room, nursing home room, care unit or bedroom.

Another object of the invention is to provide a bedside cabinet that reduces the clutter and unsightliness of various appliances, for example, a portable commode and walker.

A further object of the invention is to provide a bedside cabinet that heightens the ambiance of a room containing a commode and/or a walker and hence, increases the feeling of wellness.

To overcome the disadvantages of traditional bedside cabinets and appliances, the present invention provides a bedside cabinet that stores a commode and/or a walker when they are not in use.

According to the principles of the present invention and in accordance with the described embodiments, the present invention provides a bedside cabinet having an enclosure with an internal storage compartment and a commode located in the storage compartment.

In accordance with another embodiment of the invention, the bedside cabinet comprises a generally U-shaped base cabinet section with a U-shaped enclosure and an access opening extending unobstructed to the floor. The cabinet further includes a drawer cabinet section connected to and above the base cabinet section. A top panel is connected to the upper end of the drawer cabinet section and has a generally smooth top surface. In one aspect of this invention, the base section has a storage compartment with a door for selectively opening and closing the access opening. A commode is sized to pass through the access opening without interference and is stored in the storage compartment. In accordance with another feature of the invention, a walker is sized and shaped to fit around the drawer and base cabinet sections and is supported by the bedside cabinet to hang above the floor when not in use.

In accordance with another aspect of the invention, the top panel is rotatably hinged at a forward edge of the drawer cabinet section to permit the top panel to pivot between generally horizontal and vertical positions. The bedside cabinet further includes a shelf mounted within the cabinet below the top panel. The shelf includes a support and a manually operable clamp for locking the shelf at a desired elevated position. The shelf is raised after the top panel is pivoted to a generally vertically position; and after the shelf is clamped in its elevated position, and the top panel is then moved back to its generally horizontal position.

In accordance with another embodiment of the invention, the portable commode includes a base structure, a seat mounted in a generally horizontal position on top of the base structure, and a bowl mounted below the seat and extending beneath an opening in the seat. The commode further includes a pair of wings pivotally mounted to the opposing sides of the base structure and the seat. The wings may be pivoted to a generally vertical position immediately adjacent the base structure thereby adapting the commode for storage in a cabinet. The wings may also be moved to a generally horizontal position in which the wings extend laterally and horizontally away from the opposing sides of the base structure, thereby adapting the commode for mounting on a bed. In another aspect of this invention, the bowl is mounted under the seat; and the base structure of the commode provides access for the bowl to be removed and reinstalled underneath the seat through the rear side of the base structure. These and other objects and advantages of the present invention will become more readily apparent during the following detailed description together with the drawings herein.

BRIEF DESCRIPTION OF THE DRAWINGS

FIG. 2 is a cross-sectional view taken along line 2—2 of FIG. 1 illustrating the U-shaped base cabinet section.

FIG. 3 is a cross sectional view illustrating the elevatable shelf of the bedside cabinet.

FIG. 6 is a partial perspective view illustrating a support wing of the commode.

FIG. 7 is an enlarged cross-sectional view of the support wing joint of the commode.

DETAILED DESCRIPTION OF THE INVENTION

Figure 1:
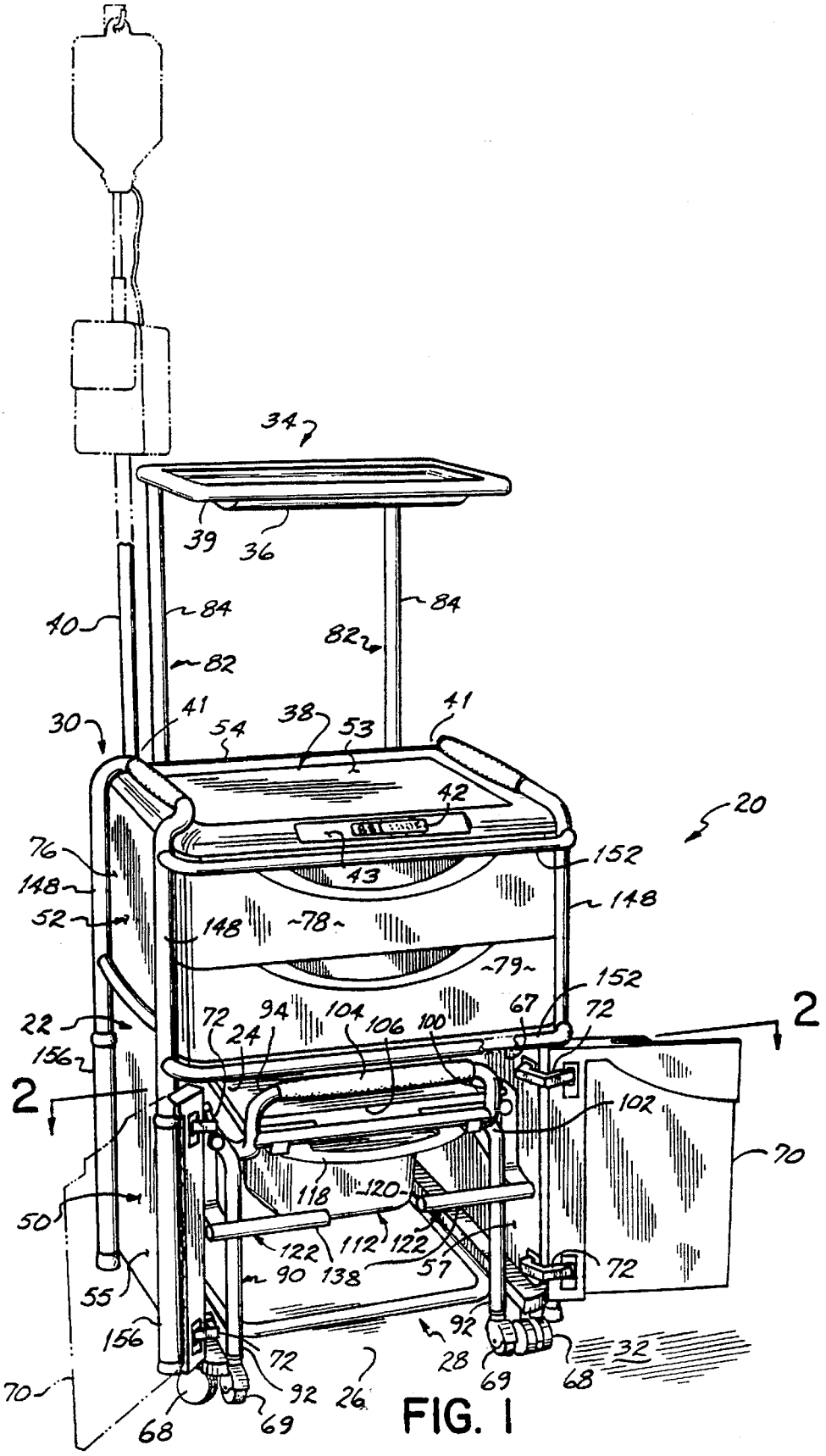
FIG. 1 is a perspective view of a bedside cabinet in accordance with the principals of the present invention.
Figure 4:
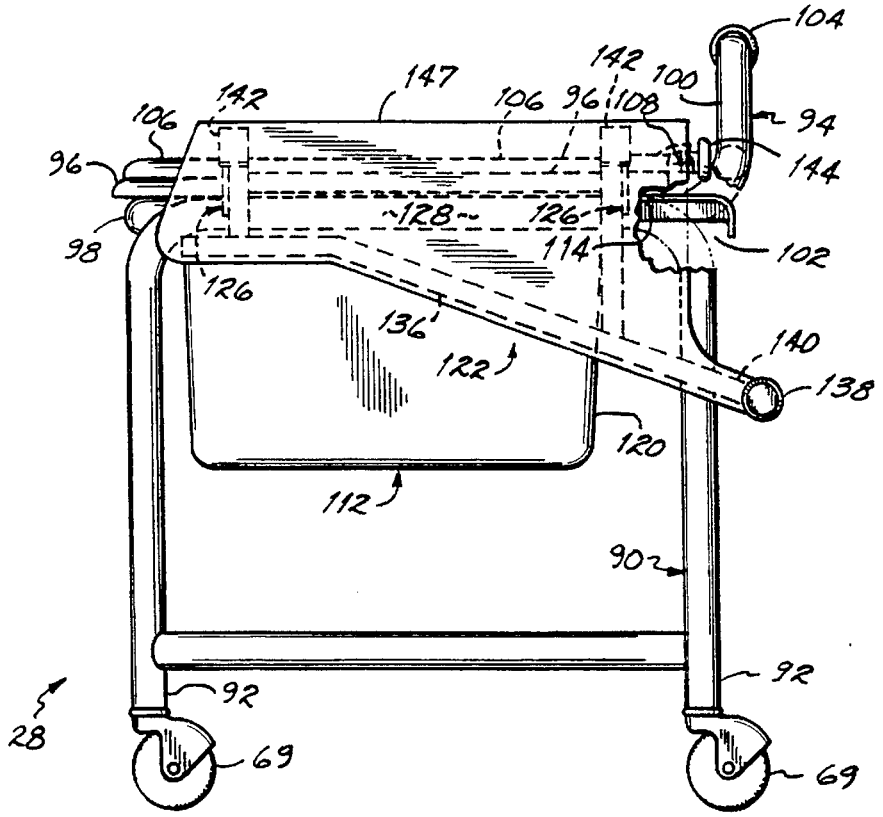
FIG. 4 is a side elevation view of the portable commode of the present invention.
Figure 5:
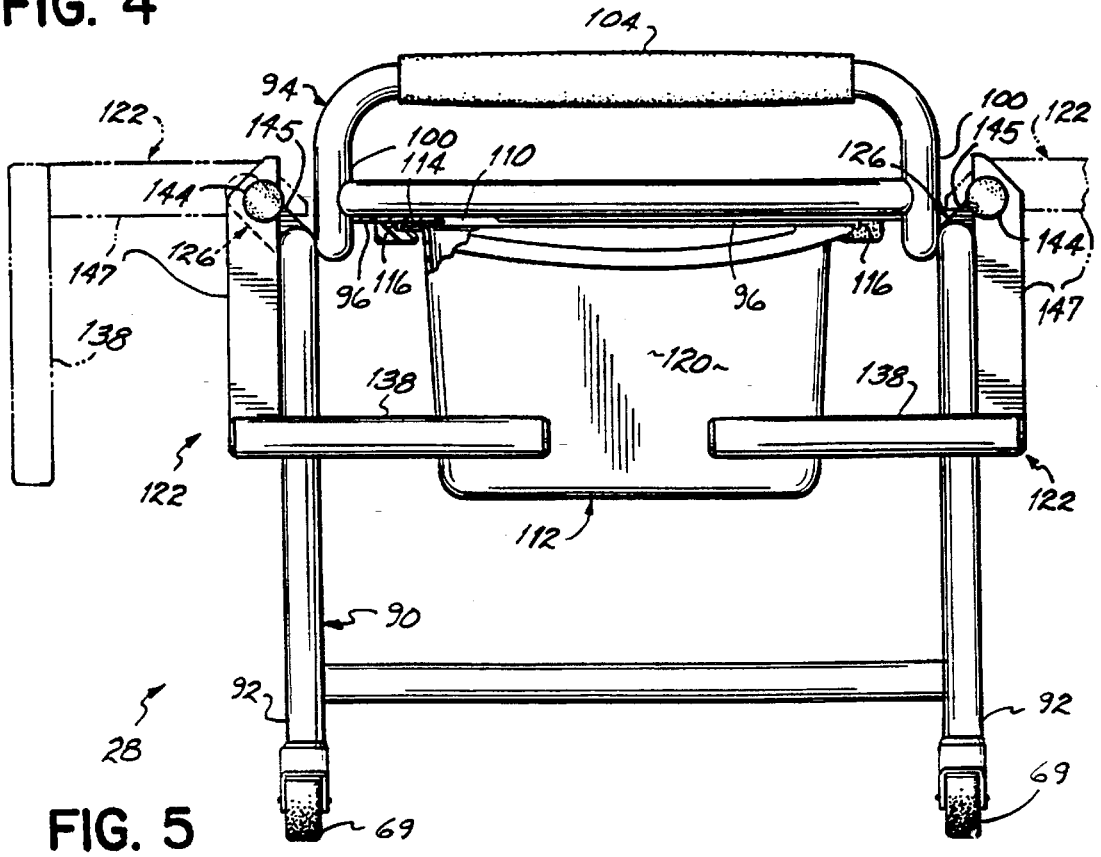
FIG. 5 is a rear elevation view of the portable commode of the present invention.

Referring to FIG. 1, a bedside cabinet 20 includes a housing or enclosure 22 that has an internal storage compartment 24 with an access opening 26 to the storage compartment. A portable commode 28 is sized to pass through the opening 26 and be stored within the compartment 24 of the bedside cabinet 20. A walker 30 is sized and shaped to fit around and be supported by the bedside cabinet 20 above a floor 32. In addition, the bedside cabinet 20 includes an adjustable, elevatable shelf 34 that may be raised above a top panel 38 and locked at different elevations. When not in use, the shelf 34 stores beneath the top panel 38. The base cabinet 20 further provides for the mounting of an IV pole 40 at either of the rear corners 41 of the bedside cabinet 20. The bedside cabinet 20 further includes an alarm clock 42 mounted on a forward beveled surface 43 front of the cabinet 20, and a power strip 44 mounted on a rearward beveled surface 45 shown in FIG. 3 along the rear upper edge 46 of the top panel 38. The power strip 44 includes phone jacks and standard power receptacles for appliances. The elevatable shelf 34 includes a light 36 mounted on a lower surface 39 of the shelf 34.

The bedside cabinet 20 of FIG. 1 is designed to be a multi-functional storage device that further includes a generally U-shaped base cabinet section 50, and a drawer cabinet section 52 connected to and above the base cabinet section 50. The top panel 38 is connected to and above the drawer cabinet section 52, and further includes a smooth top surface 53. Preferably, the surface 53 is surrounded by a raised lip section 54 to prevent items from easily sliding off the top surface 53. As shown in FIGS. 1 and 2, the base cabinet section 50 includes three side walls 55, 56, 57 that are connected together to form the generally U-shaped enclosure or storage compartment 24. The walls 55, 56, 57 are mounted on respective legs 58, 59, 60 of a generally U-shaped base frame 61. The legs 58, 59, 60 of the base frame 61 are preferably made of pieces of square tubing welded at their ends to the sides of tubing corner posts 63 extending perpendicularly with respect to the legs 58, 59, 60. The legs 58, 59, 60 are preferably mounted within a generally U-shaped molded base member 64. The molded base member 64 is preferably a plastic-type of material that is pleasing in appearance, colored to match the walls 55, 56, 57 and is further made from a relatively durable and resilient material. To provide additional stability to the vertical corner posts 63, angle brackets 65 are connected and preferably welded between the tubing pieces 62 of legs 58, 60 and the corner posts 63. The corner posts 63, which extend generally vertically through the height of the bedside cabinet 20, have IV pole supports 66 shown in phantom in FIG. 2. Referring to FIG. 1, the IV pole supports 66 are located at the rear of the base cabinet 20, and are sized to receive and stabilize an IV pole 40.

The storage compartment 24 and associated access opening 26 are preferably open and unobstructed from a lower edge 67 on a front side of the drawer cabinet section 52 to the floor 32. Preferably, casters 68 are connected at the four corners of the base cabinet section 50 thereby permitting the base cabinet 20 be easily moved over the floor 32. In addition, casters 69 are preferably attached to the four corners of the commode 28 thereby permitting the commode 28 to be easily moved over the floor 32, through the access opening 26 and into and out of the storage compartment 24. Doors 70 are connected with hinges 72 to the forward edges 74 of the sidewalls 55, 57 and are used to selectively cover or allow access to the storage compartment 24.

The drawer cabinet section 52 of the bedside cabinet 20 is comprised of a housing 76 in which drawers 78, 79 are slidably mounted. The housing 76 is connected to and contiguous with the walls 55, 56, 57 of the base cabinet section 50. As shown in FIG. 3, the drawers 78, 79 are mounted within the housing 76 on commercially available drawer glides 80. The top panel 38 is rotatably mounted to the housing 76 by means of hinge pins or pivot pins 81 which permit the top panel 38 to pivot approximately 90° between a horizontal position and a vertical position as shown in phantom in FIG. 3.

The adjustable shelf 34 is stored within the bedside cabinet 20 immediately below the top panel 38. The shelf 34 includes a pair of generally L-shaped support brackets 82, each of which has a generally horizontal arm 83 attached to the bottom surface of the shelf 34. The horizontal arms 83 have a length that preferably extends from the back to the front, that is, across most of the depth of the shelf 34. The support brackets 82 further have generally vertical arms 84 which are slidably mounted within respective vertical bores 85 of a pair of manually operable clamps 86. The clamps 86 are connected to a generally horizontal cross member 87 which is connected and preferably welded at its ends to the sides of corner posts 63. Further each of the clamps 86 contains a manually operable locking screw 88 by which the vertical arm 84 and in turn the adjustable shelf 34 are selectively locked and released from desired vertical positions. Therefore, the adjustable shelf 34 may be locked at an elevation above the top panel 38 as indicated in phantom in FIG. 3.

FIGS. 4–7 illustrate the details of construction of the commode 28. The commode 28 is designed to be coupled within a foot end cavity of a foot egress hospital bed as disclosed in U.S. patent application Ser. No. 08/277,243 filed on Jul. 19, 1994 and assigned to the assignee of the present application, the entire substance of which is hereby incorporated by reference herein as if fully set forth in its entirety. The commode 28 has a generally rectangular base 90 preferably made from steel tubing with four legs 92 at its corners to which the casters 69 are connected. A generally rectangular seat support 94 also preferably made from steel tubing is rigidly connected, preferably welded, to the base 90. The seat support 94 is preferably L-shaped, and a commode seat 96 is fastened to generally horizontal legs 98 of the seat support 94. Generally vertical legs 100 of the seat support 94 are connected to the horizontal legs 98 at the rear side of the commode located at 102. The vertical legs 100 are connected at their upper ends by a handle 104 for moving the commode 28 across the floor 32.

The commode seat 96 includes a commode seat cover 106 rotatably connected to the seat 96, preferably with a hinge pin or pivot pin in a well known manner, to permit the commode seat cover 106 to rotate about an axis of rotation at 108 and move between open and closed positions. The commode seat 96 further has a generally centrally located opening 110 extending therethrough to provide access to a commode bowl 112 mounted underneath the seat 96 and extending beneath the opening 110. Preferably, the bowl 112 includes a peripheral flange 114 which slidingly engages slots 116 located on the bottom of the seat 96. Further, the base 90 is constructed to have a generally unobstructed opening at the rear side 102 so that the commode bowl 112 may be installed and removed through the rear side 102 of the base 90. The bowl 112 further includes a handle 118 extending laterally from the rear side 120 of the bowl 112 so that when the bowl 112 is installed, the handle 118 is conveniently located at the rear side 102 of the commode 28.

The commode 28 further includes a pair of pivoting wings 122 each of which is located on one of the opposed sides of the commode 28. The construction and operation of the wings 122 are identical. The wings 122 are preferably designed to pivot approximately 90° between a generally horizontal position and a generally vertical position as shown in phantom in FIG. 5. When the wings 122 are folded in their generally vertical position, the commode 28 has a width, that is, the distance between the outermost sides of the folded wings 122, which is less than the width of the opening 26 (FIG. 1) of the base cabinet 20. Further, the height of the commode 28, that is, the distance from the floor 32 to the uppermost surface of the handle 104 is less than the distance from the floor 32 to the lower edge 67 on the front side of the bedside cabinet 20. Further, the depth of the commode 28, that is, the distance from its most forward point to its most rearward point, is less than the depth of the storage compartment 24 in the base cabinet section 50 of the bedside cabinet 20. Therefore, preferably the commode 28 is completely contained within the storage compartment 24 when the doors 70 are in their closed position.

Referring to FIG. 6, each wing 122 has a first generally longitudinal frame element 124 rotatably mounted at its ends by end pins 125 extending through mating holes in mounting plates 126. The mounting plates 126 are in turn rigidly connected to a generally horizontal upper element 128 extending and connecting the front and rear sides of the base 90. Brackets 130, 132 are rigidly connected at a point intermediate their ends to the rotatable first longitudinal element 124. First ends 131 of the brackets 130, 132 are connected to a second longitudinal element 136. The second element 136 preferably includes a coupling leg 138 extending approximately 90° from the rearward most end 140 of the second longitudinal element 136. The second ends 141 of the brackets 130, 132 have stop plates 142 welded to the uppermost surfaces of the brackets 130, 132. Each of the stop plates 142 extends past the side edges of the brackets 130, 132 to form an overhang or shoulder 143. The shoulders 143 are sized, that is, extend longitudinally toward the ends of the wings 122 so that they overlay a substantial portion and preferably all of the area of the uppermost surfaces 145 of the plates 126. Therefore, when the wings 122 are pivoted to their generally horizontal position, as shown in FIG. 7, the shoulders 143 of the stop plates 142 firmly contact the upper surfaces 145 of mounting plates 126. The wings 122 are retained in their generally horizontal position by a spring-loaded pin 144 which is mounted preferably in one, preferably the rearward one, of the mounting plates 126, and extends through a mating hole 146 in the bracket 132. Each of the wings 122 may be covered with a shroud 147 preferably of plastic to improve its appearance.

Figure 8:
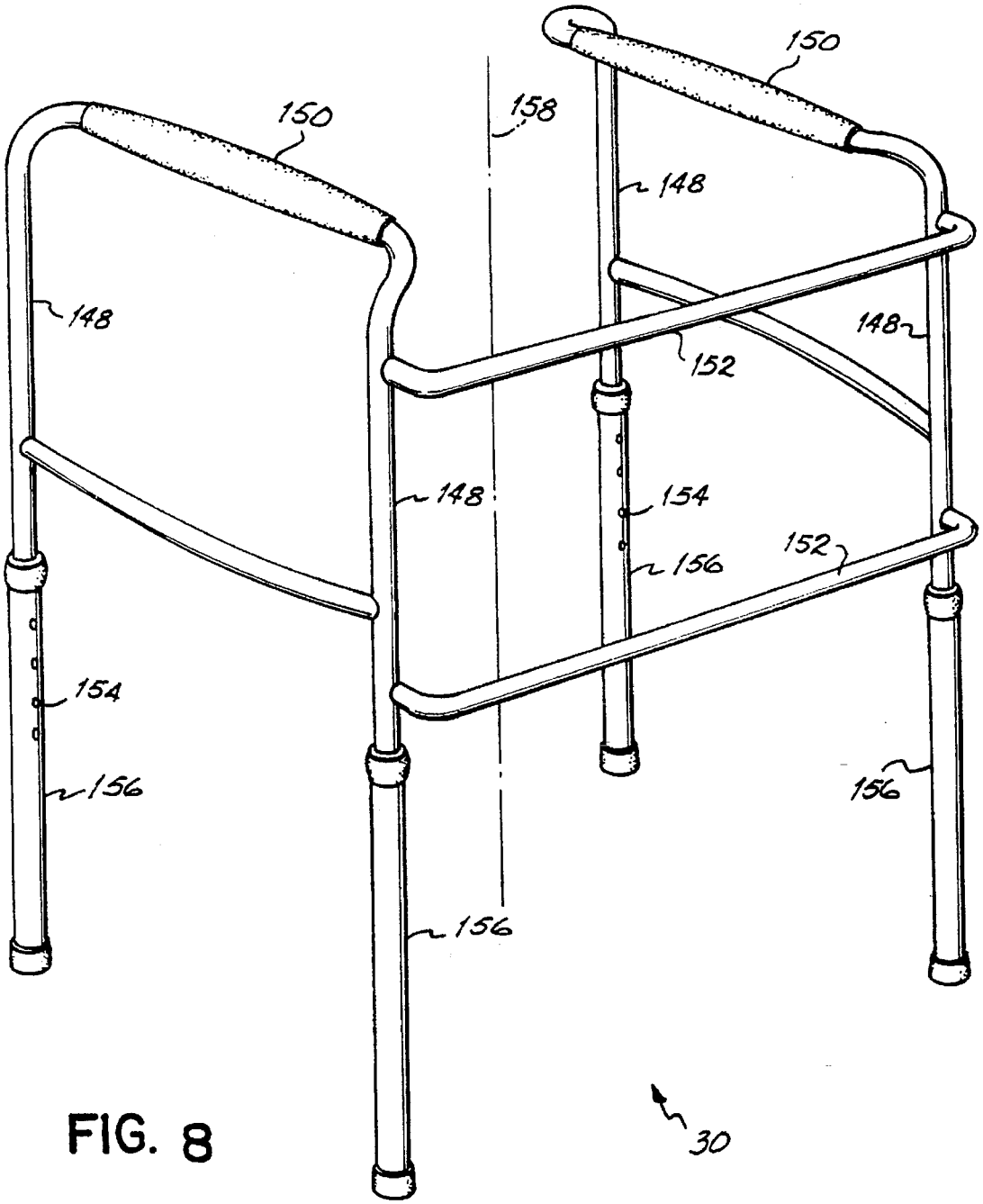
FIG. 8 is a perspective view of a walker for use with the bedside cabinet of the present invention.

FIGS. 1 and 8 illustrate a walker 30 designed for use with the present invention. The walker 30, which is designed to be an aid and support for those who have difficulty walking, has four generally vertical upper legs 148. The legs 148 are connected laterally by handles 150 extending between the upper ends of the legs 148 and by forward cross members 152 extending between the legs 148 intermediate their ends on the forward side of the walker 30. Mounted in each of the legs 148 is a spring-loaded button or pin 154 which extends through the sidewall of a tubular and extendable lower leg 156 that is slidably mounted over the upper legs 148 in a telescoping manner. Therefore, the overall length of the legs 148, 156 may be adjusted to fit the user. The forward cross members 152 have a length that permits the walker 30 to fit around the bedside cabinet 20. The handles 150 are connected to the upper ends of the legs 148 and are curved and directed inwardly toward the centerline 158 of the walker 30. The distance between the opposed ends 160 of the handles 150 may be fixed to, for example, 20 inches, or made to different distances to accommodate users of different size. Further, as illustrated in FIG. 8, the forward cross members 152 extend forward of the legs 148 so that, as illustrated in FIG. 1, when the walker 30 is stored on the bedside cabinet 20, the legs 148, 156 do not interfere with the operation of the doors 70. The forward cross members 152 are also positioned vertically on the upper legs 148 so that when the walker is stored on the bedside cabinet 20, the cross members 152 do not interfere with the operation of the drawers 78, 79, or the doors 70. While FIG. 1 illustrates the walker as being mounted across the front of the of the bedside cabinet, if regular use is not anticipated or for any other reason, the walker can also be mounted across the rear of the bedside cabinet, thereby leaving the front of the bedside cabinet open.

In use, the bedside cabinet 20 of FIG. 1 provides a compact, multi-functional unit that may be used in a hospital room, a nursing unit, a residential bedroom, or any other health care environment. The bedside cabinet 20, in its preferred embodiment, is designed to store the commode 28 within the base cabinet section 50, to hang the walker 30 from the top panel 38, and to store the adjustable shelf 34 underneath the top panel 38. With the doors 70 closed, the commode 28 is out of sight and out of the way. Further, since both the bedside cabinet 20 and the commode 28 have independent casters, they may be moved as a single unit to any desired location.

When the doors 70 are opened, the commode 28 is easily removed from the bedside cabinet 20 and is preferably coupled to the foot cavity of a foot egress bed. When used with such a bed, the wings are raised to their horizontal position. The patient support platform of the bed preferably has plates over which a forward portion of the wings 122 are positioned to provide lift points on each side of the commode approximately below the brackets 130, 132. In addition, the patient support platform on the bed preferably has latching mechanisms that latch or couple onto the legs 138 and provide second lift points immediately below the second longitudinal elements at the ends 140 connected to the legs 138. Consequently, as the patient support platform of the bed is raised to assist the user in moving to a standing position, the support platform of the bed also lifts the commode 28 by its wings 122 to assist the user in moving to a seated position on the commode. When coupled to the bed, the commode bowl 112 is easily removed through the rear side 102 of the commode 28, cleaned, and reinstalled without having to have access to the commode 28 from the top.

At any time during use, the top panel 38 may be pivoted with respect to its pivot pins 81 located on the forward edge of the drawer cabinet section 52 and moved to a generally vertical position. The adjustable shelf 34 may then be elevated from within the bedside cabinet 20 and using the clamps 86, the shelf 34 is locked in a desired elevated position, and thereafter the top panel 38 is returned to its generally horizontal position. Further, at any time, the walker 30 may be easily and quickly removed from the cabinet 20, and subsequently rehung on the cabinet 20 so that it is conveniently stored out of the way.

While the invention has been set forth by a description of the embodiments in considerable detail, it is not intended to restrict or in any way limit the claims to such detail. Additional advantages and modifications will readily appear to those who are skilled in the art. For example, the door hinges 72 which pivot the doors 70 to opened and closed positions to cover the storage compartment 24 may alternatively be mounted on sliding hinges so that the doors 70 can be slid back into the bedside cabinet 20 into a position in which they are parallel to the sidewalls 55, 57 of the base cabinet section 50. In addition, the clamps 86 securing the vertical arms 84 of the shelf bracket 82 may utilize the disclosed threaded locking screw 88 that extends through holes in the wall of the vertical arm 84 or alternatively may simply push against the outside surface of the vertical arm 84 with sufficient force to keep the arm 84 from sliding vertically within the clamp 86. Further, it will be appreciated that the commode 28 may be utilized without the pivoting wings 122 and be readily stored within the base cabinet section 50. With that alternative, preferably, the casters 69 are removed from the base 90. The invention therefore in its broadest aspects is not limited to the specific details shown and described. Accordingly, departures may be made from the details described herein without departing from the spirit and scope of the invention.

What is claimed is:

1. A bedside cabinet located on a floor and comprising:

a generally U-shaped base cabinet section having:

three side walls each having an upper edge, a lower edge, and opposing side edges extending between the upper and lower edges being coupled together to define a rear panel and opposing side panels, the side edges of the opposing side panels opposite the rear panel cooperate to define a front side of the base cabinet section, and the rear and side panels are configured to define an internal storage compartment therebetween and an access opening extending through the front side of the base cabinet section and from the lower edges of the three side walls unobstructed to the floor, casters connected to the generally U-shaped base cabinet section for supporting the base cabinet section on the floor, and at least one door operatively connected to the generally U-shaped base cabinet section for selectively covering a substantial portion of the internal storage compartment;

a drawer cabinet section being connected to and above the generally U-shaped base cabinet section and including a hinge mounted thereon; and a top panel positioned to lie above the drawer cabinet section, the top panel being coupled to the hinge to pivot between a generally horizontal and a generally vertical position with respect to an axis of rotation adjacent the front side of the cabinet.

2. The bedside cabinet of claim 1 further comprising a commode located within the internal storage compartment, the commode being sized to permit movement of the commode into and out of the access opening.

3. The bedside cabinet of claim 2 wherein the commode further comprises casters for permitting the commode to easily be moved over the floor.

4. The bedside cabinet of claim 1 further comprising a walker for assisting a person in ambulatory activity, the walker being sized and shaped to fit around the drawer cabinet section and the side walls of the base cabinet section and be supported by the bedside cabinet above the floor, whereby the bedside cabinet stores the walker when not in use.

5. The bedside cabinet of claim 1 further comprising:

a shelf mounted within the bedside cabinet below the top panel;

at least one vertical support rail connected to the shelf; and a manually operable clamp connected adjacent a rearward edge of the bedside cabinet for receiving the vertical support rail, the shelf being adapted to be raised to an elevated position above and spaced apart from the top panel upon the top panel being pivoted to the generally vertical position and the manually operable clamp securing the shelf in the elevated position independent of the top panel being selectively moved to either the generally horizontal position and the generally vertical position.

6. The bedside cabinet of claim 1 wherein the drawer cabinet section comprises a pair of drawers slidingly mounted in the drawer cabinet section one above the other.

7. The bedside cabinet of claim 1 wherein the at least one door further comprises a pair of doors.

8. The bedside cabinet of claim 1 further comprising an IV pole support connected thereto and adapted to receive one end of an IV pole for supporting the IV pole in the generally vertical position.

9. A bedside cabinet located on a floor and comprising:

a cabinet base having side walls coupled together to define a front side, an opposite rear side, and an internal storage compartment therebetween, and the internal storage compartment being formed to include an access opening extending unobstructed through the front side and to the floor;

a top panel being coupled to and above the cabinet base, the top panel including a forward edge adjacent the front side of the cabinet base and an opposite rearward edge adjacent the rear side of the cabinet base;

hinges being connected between the top panel and the cabinet base adjacent the forward edge of the top panel for permitting the top panel to pivot between a generally horizontal position and a generally vertical position about an axis of rotation adjacent the front side of the cabinet base;

a shelf mounted within the cabinet base below the top panel;

at least one vertical support rail connected to the shelf; and a manually operable clamp connected adjacent the rear side of the cabinet base for receiving the vertical support rail, the shelf being adapted to be raised to an elevated position spaced apart above the top panel upon the top panel being pivoted to the generally vertical position and the manually operable clamp securing the shelf in the elevated position independent of the top panel being selectively moved to either the generally horizontal position and the generally vertical position.

10. A bedside cabinet assembly formed to be located on a floor, the cabinet assembly comprising:

a base cabinet section having side walls coupled together to define a front side, a back side, and an internal storage compartment between the front and back sides and the internal storage compartment is formed to include an access opening extending through the front side of the base cabinet section and from the side walls unobstructed to the floor, casters being coupled to the side walls to support the base cabinet section on the floor, at least one door pivotably coupled to the base cabinet section and configured to selectively cover at least a portion of the access opening through the front side, a drawer cabinet section being coupled to the side walls, a top panel being coupled to the drawer cabinet section, a commode being positioned to lie within the internal storage compartment and sized to permit selective movement of the commode through the access opening and into and out from the internal storage compartment, and a walker configured to assist a person in ambulatory activity, the walker is sized and shaped to fit around the drawer cabinet section and the side walls of the base cabinet section so that it is positioned to lie above the floor.

11. The cabinet assembly of claim 10, further comprising a hinge coupled between the top panel and the drawer cabinet section, and the hinge is configured to enable the top panel to pivot between a generally horizontal and a generally vertical position with respect to an axis of rotation adjacent the front side of the base cabinet section.

12. The cabinet assembly of claim 11, further comprising a shelf positioned to lie between the drawer cabinet section and the top panel.

13. The cabinet assembly of claim 12, further comprising at least one vertical support rail connected to the shelf and a clamp coupled to one of the side walls of the base cabinet section, the clamp is configured to receive the vertical support rail, the shelf is adapted to be raised to a position spaced apart from the drawer cabinet section and the top panel when the top panel is pivoted to the generally vertical position and the clamp is moved to a generally horizontal position or a generally vertical position.

14. The cabinet assembly of claim 10 wherein the drawer cabinet section comprises a drawer mounted in the drawer cabinet section.

15. The cabinet assembly of claim 10, wherein the commode further comprises casters positioned to lie on the floor.

16. The cabinet assembly of claim 10, further comprising an IV pole support coupled thereto, and the IV pole support is adapted to receive and hold an IV pole in a general vertical position.

17. A bedside cabinet assembly formed to be located on a floor, the cabinet assembly comprising:

a base cabinet section having side walls coupled together to define a front side, a back side, and an internal storage compartment therebetween and the internal storage compartment is formed to include an access opening extending through the front side of the base cabinet and from the side walls unobstructed to the floor, casters being coupled to the side walls to support the base cabinet section on the floor, at least one door pivotably coupled to the base cabinet section and configured to selectively cover at least a portion of the access opening through the front side, a drawer cabinet section being coupled to the side walls, a top panel being coupled to the drawer cabinet section, and a walker configured to assist a person in ambulatory activity, the walker being sized and shaped to fit around the drawer cabinet section and the side walls of the base cabinet section so that it is positioned to lie above the floor.

18. The cabinet assembly of claim 17, further comprising a commode positioned to lie within the internal storage compartment.

19. The cabinet assembly of claim 18, wherein the commode is formed to include casters thereon.

20. The cabinet assembly of claim 18, wherein the commode is sized for movement through the access opening into and out from the internal storage compartment.

21. The cabinet assembly of claim 17, further comprising a hinge coupled between the top panel and the drawer cabinet section, and the hinge is configured to enable the top panel to pivot between a generally horizontal and a generally vertical position with respect to an axis of rotation adjacent the front side of the base cabinet section.

22. The cabinet assembly of claim 21, further comprising a shelf positioned to lie between the drawer cabinet section and the top panel.

23. The cabinet assembly of claim 22, further comprising at least one vertical support rail connected to the shelf and a clamp coupled to one of the side walls of the base cabinet section, the clamp is configured to receive the vertical support rail, the shelf is adapted to be raised to a position spaced apart from the drawer cabinet section and the top panel when the top panel is pivoted to the generally vertical position and the clamp is moved to either a generally horizontal position or a generally vertical position.

24. The cabinet assembly of claim 17 wherein the drawer cabinet section comprises a drawer positioned to lie therein.

25. The cabinet assembly of claim 17, further comprising an IV pole support coupled thereto, and the IV pole support is adapted to receive and hold an IV pole in a general vertical position.

* * * * *